US006299402B1

(12) United States Patent
Sabelström

(10) Patent No.: US 6,299,402 B1
(45) Date of Patent: Oct. 9, 2001

(54) COVER INTENDED FOR THE FABRICATION OF A BOOKLET, A METHOD OF HANDLING SUCH COVERS, AND A METHOD OF FABRICATING SUCH BOOKLETS

(75) Inventor: Jan Sabelström, Huddinge (SE)

(73) Assignee: Bindomatic AB, Stockholm (SE)

( * ) Notice: Subject to any disclaimer, the term of this patent is extended or adjusted under 35 U.S.C. 154(b) by 0 days.

(21) Appl. No.: 09/297,945

(22) PCT Filed: Nov. 10, 1997

(86) PCT No.: PCT/SE97/01877

§ 371 Date: May 10, 1999

§ 102(e) Date: May 10, 1999

(87) PCT Pub. No.: WO98/21049

PCT Pub. Date: May 22, 1998

(30) Foreign Application Priority Data

Nov. 11, 1996 (SE) ..... 9604126

(51) Int. Cl.[7] ..... B42C 9/00; B42C 11/00

(52) U.S. Cl. ..... 412/1; 412/4; 412/8; 412/5; 412/900; 412/19

(58) Field of Search ..... 412/1, 4, 8, 19, 412/21, 900, 902; 156/289, 908

(56) References Cited

U.S. PATENT DOCUMENTS

| | | | | |
|---|---|---|---|---|
| 4,009,498 | * | 3/1977 | Staats et al. | 156/583 |
| 4,106,148 | * | 8/1978 | Axelrod | 270/32 |
| 4,179,325 | * | 12/1979 | Staats et al. | 156/498 |
| 4,289,330 | * | 9/1981 | Wiermanski | 281/21 |
| 4,527,814 | * | 7/1985 | Carter et al. | 281/31 |
| 4,556,595 | * | 12/1985 | Ochi | 428/143 |
| 4,740,416 | * | 4/1988 | De Coste, Jr. et al. | 428/240 |
| 4,906,497 | * | 3/1990 | Hellmann et al. | 428/49 |
| 4,907,822 | * | 3/1990 | Carter et al. | 281/36 |
| 5,008,139 | * | 4/1991 | Ochi et al. | 428/40 |
| 5,078,563 | * | 1/1992 | Lolli | 412/8 |
| 5,156,510 | * | 10/1992 | Uehara | 412/8 |
| 5,194,116 | * | 3/1993 | Davis et al. | 156/578 |
| 5,308,208 | * | 5/1994 | Ranson | 412/5 |
| 5,340,155 | * | 8/1994 | Podosek | 281/29 |
| 5,425,981 | * | 6/1995 | Bruning et al. | 428/198 |
| 5,570,985 | * | 11/1996 | Latvakangas et al. | 412/4 |

(List continued on next page.)

FOREIGN PATENT DOCUMENTS

3545600 * 6/1987 (DE) .

*Primary Examiner*—Willmon Fridie, Jr.
*Assistant Examiner*—Monica S. Carter
(74) *Attorney, Agent, or Firm*—Cooper & Dunham LLP

(57) ABSTRACT

According to one aspect, the invention relates to a method of stacking covers for the fabrication of booklets. Each cover includes two cover sheets and an interconnecting spine. Applied to the inner surface of the spine is a binding device that includes a binding agent. The covers are mutually stacked with the inner surface of the spine of one cover lying against the outer surface of the spine of an adjacent cover. According to the invention, a deactivatable separating device is provided between the binding agent and the outer surface of the spine of an adjacent cover, so as to prevent adhesion between the spines of respective covers. According to another aspect of the invention, a cover of this kind is provided with a binding device that includes a binding agent (104) and a separating device (105) disposed on the surface of the binding agent that lies remote from the spine (103), this separating device preferably having a form of woven material affixed to the binding agent (104). The invention also comprises a method of producing a booklet with the use of the inventive cover. According to the inventive method of fabrication, the separating device is deactivated at the same time as the binding agent is activated and a sheet bundle is moved in towards the spine of the cover.

16 Claims, 3 Drawing Sheets

U.S. PATENT DOCUMENTS 5,589,246 * 12/1996 Callhoun et al. ..... 428/120
5,672,030 * 9/1997 Dean ..... 412/7
5,868,539 * 2/1999 Rathert ..... 412/5
5,888,650 * 3/1999 Calhoun et al. ..... 428/354
5,889,118 * 3/1999 Delgado et al. ..... 525/228
5,906,883 * 5/1999 Blanc Brude ..... 428/178
5,968,633 * 10/1999 Hamilton et al. ..... 428/174

* cited by examiner

COVER INTENDED FOR THE FABRICATION OF A BOOKLET, A METHOD OF HANDLING SUCH COVERS, AND A METHOD OF FABRICATING SUCH BOOKLETS

FIELD OF INVENTION

According to a first aspect, the present invention relates to a method of stacking covers of the kind defined in the preamble of claim 1 and intended for the production of booklets. According to a second aspect, the invention relates to a cover of the kind defined in the preamble of claim 7 and intended for a booklet, and according to a third aspect the invention relates to a method of fabricating a booklet of the kind defined in the preamble of claim 14.

BACKGROUND OF INVENTION

It is known to fabricate booklets with a starting point from covers of the kind in question. Such covers and methods of booklet fabrication with a starting point from said covers are described in WO 94/265 35, among other publications.

These known covers and methods enable high quality booklets to be produced in a simple and rational manner in environments which do not primarily relate to the production of booklets, folders or books. Even though the known covers and methods can be used and applied in such primary production, they are primarily intended for the fabrication of booklets which are sub-handling products, e.g. products in office environments in which different types of printing matter is to be presented in a functional manner, and which afford the greatest advantages in such production. The area of use extends from booklets that contain only a few sheets of paper to compendiums that include several hundreds of sheets or pages. The method of production enables the fabrication of booklets ranging from just a few booklets to relatively large series comprising several tens of thousands of booklets to be achieved in an economic manner with method implementations that are adapted to the size of the series intended.

However, the known covers and the methods applied in the fabrication of booklets on the basis of these covers are encumbered with a binding-agent related problem. The binding agent is comprised of a strip of adhesive material or substance applied firmly to one side of the spine of the cover, said adhesive strip or layer being brought into abutment with the bundle of paper sheets inserted between the cover sheets and the adhesive activated, e.g. , by applying heat thereto. The binding agent is therewith converted from a solid state to a molten or semi-molten state, so as to enable the sheets to penetrate into the binding agent. When the binding agent is caused to harden, the sheets are firmly anchored in the cover and therewith complete the booklet.

It has been found, however, that the binding agent is adhesive to some extent even when in a solid state, particularly when the binding agent lies against a surface over a long period of time and under a certain degree of pressure. This adhesiveness it undesirable and can cause problems in some cases. This applies in particular to the case when the covers are stored and handled while nested together in stacks, with the inner surface of the spine of one cover in abutment with the outer surface of the spine of an immediately adjacent cover and the string of binding agent in contact with said outer spine surface. This is the case when the covers are mutually nested in a V-shaped stack in the type of magazine described in the aforementioned patent specifications.

The covers are thus liable to stick together and therewith cause disturbances in production, particularly in view of the relatively high degree of mechanization employed in the use of the binding machines described in said patent specification.

SUMMARY OF INVENTION

Against this background, the object of the present invention is to attempt to eliminate the problem of adhesion between covers that are to be used in the fabrication of booklets and that are stacked together with the spines of the covers in mutual abutment.

According to a first aspect of the invention, this object is achieved by a cover stacking method of the kind defined in the preamble of claim 1 and comprising the particular steps set forth in the characterizing clause of said Claim.

The expression activatable binding agent as used in claim 1 and in other places in the document is meant to imply that the binding agent can be activated to perform its binding function.

The term deactivatable separating means implies that the separating function of said separating means can be deactivated, i.e. caused to cease to function.

As a result of arranging special separating means between the covers in this way, the binding agent on one cover is unable to come into contact with the spine of an adjacent cover, therewith excluding the risk of the mutual adhesion of the covers.

Although the spine separating device may be comprised of a separate element which is deactivated when a cover is advanced for treatment, by removing the element from the cover, the separating device will preferably be affixed to the binding agent. This simplifies handling procedures.

Accordingly, in one preferred embodiment the separating devices have the form of woven material affixed to the binding agent. This enables the separating function of said devices to be deactivated more readily.

The covers will preferably already have been provided with such separating devices when handled for stacking purposes. In this regard, the separating devices may be applied to respective covers in conjunction with their manufacture, in a rational manner.

The aforedescribed embodiments and other advantageous embodiments of the inventive cover stacking method are set forth in the method claims dependent on claim 1.

According to a second aspect of the invention, the aforesaid object is achieved with a booklet of the kind defined in the preamble of claim 7 and having the particular features set forth in the characterizing clause of said claim.

The application of a spine separating device to the binding agent of the cover avoids the risk of the covers sticking together when nested one within the other.

In one preferred embodiment, the deactivatable separating device is intended to be deactivated in conjunction with activation of the binding agent. thus, no particular measures are required to deactivate the separating device in order to enable bending of the booklet to be carried out, and binding can be effected in one integrated step.

In a further preferred embodiment of the cover, the separating device is attached to the binding agent by virtue of parts of the device penetrating into the binding agent and parts of the device projecting out from the surface of said binding agent. This enables the separating device to be readily applied to a cover during its manufacture and easily deactivated.

The separating device will preferably comprise a woven material. Woven material can be easily applied and deactivated and also has the advantage whereby the woven material will stiffen the spine of the finished booklet.

The aforedescribed embodiments of the inventive cover and other advantageous embodiments thereof will be apparent from the claims dependent on claim 7.

According to a third aspect of the invention, the object of the invention is also achieved with a booklet fabricating method of the kind defined in the preamble of claim 14 and comprising the particular steps set forth in the characterizing clause of said claim.

There is thus provided a booklet fabricating method in which the separating device prevents undesirable adhesion of mutually adjacent covers on the one hand and with which deactivation of the separating device and activation of the binding agent are integrated on the other hand, so as to enable the actual binding operation to be accomplished without the need of special measures herefor and without the separating device disturbing or obstructing binding of the sheet bundle to the spine of the booklet.

Preferred embodiments of the inventive method will be apparent from the claims dependent on claim 14

BRIEF DESCRIPTION OF DRAWINGS

The invention will now be described in more detail with reference to preferred embodiments of the various aspects of the invention and also with reference to the accompanying drawings, in which.

DESCRIPTION OF THE PREFERRED EMBODIMENTS

Figure 1:
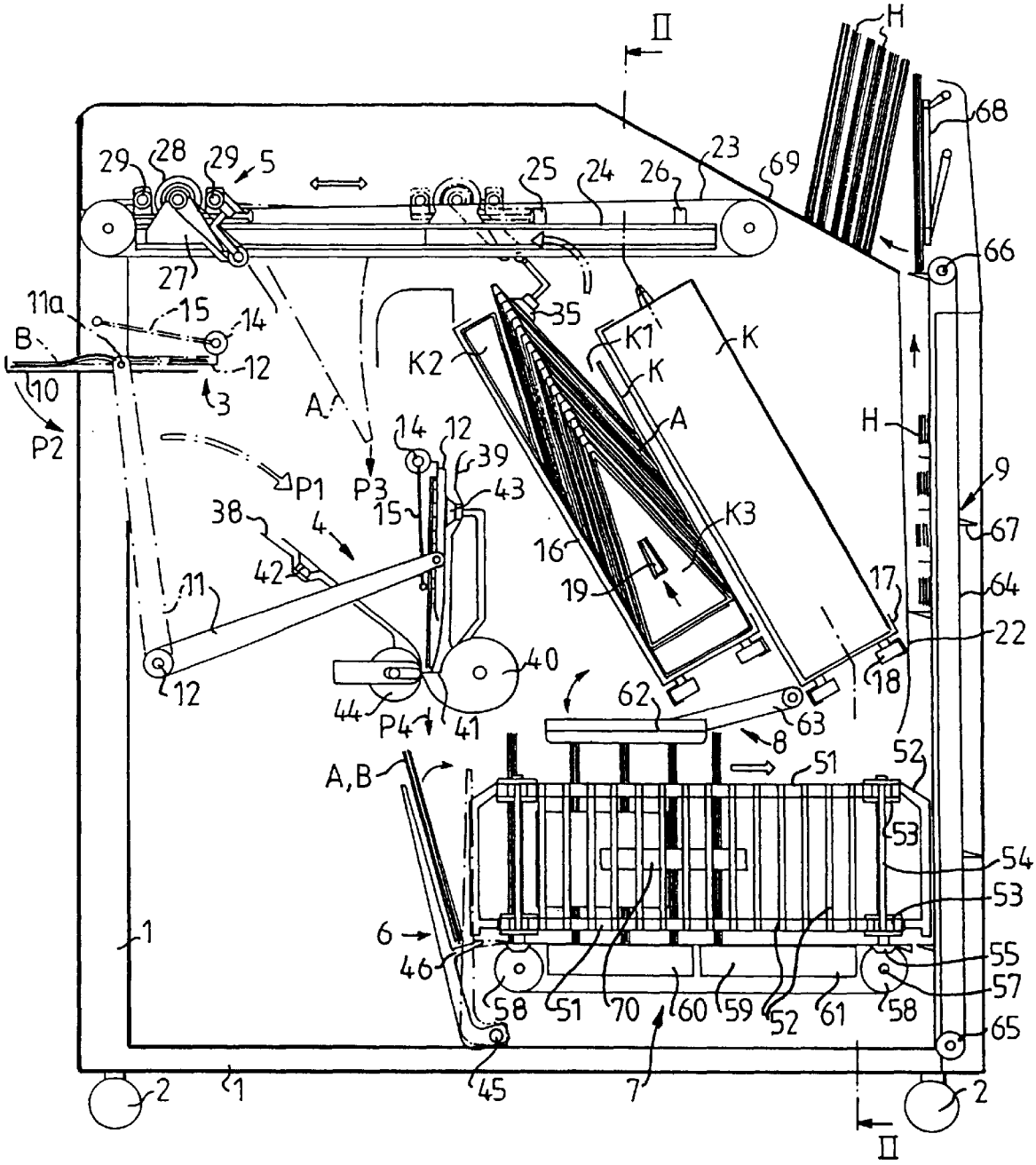
FIG. 1 illustrates a known book-binding machine with which the invention can be applied.

The binding machine illustrated in FIG. 1 is of the kind known from WO 94/26 535, for instance. The machine forms no actual part of the present invention and the description of its construction and modus operandi are intended merely to provide a background that will facilitate an understanding of the present invention.

The arrangement according to FIG. 1 is incorporated in a machine that includes a stand 1 resting on wheels 2. The main parts of the machine comprise an arrangement in the form of a platform 10 that receives bundler of loose sheets B which arrive from a copier or (laser) printer, not shown, an arrangement 3 which transports the sheet bundles to a collecting or gathering device 4, an arrangement 5 for taken covers A from a cassette K and transporting the covers to the collecting device 4 one at a time, an arrangement for collecting covers from the collecting device 7 for activation of a binding agent on the spine of each cover A, so as to bind the sheet bundle to the spine of said cover, a jogging device 8 for jogging the bundle of sheets in respective covers as said covers pass through the activating device 7, and a device 9 for transporting away the booklet H consisting of sheet bundles B bound in respective covers A.

The sheet-bundle transporting device 3 includes a plate 12 which can be inserted between the platform 10 and a sheet bundle B resting thereon and which is mounted at 11*a* on an arm 11 which is mounted at 12 and caused to swing backwards and forwards by drive means, not shown. The arrow P1 indicates this swinging movement in one direction (clockwise). The plate 12 is also caused to swing forwards and backwards on the arm 11 by drive means also not shown. The arrow P2 shows this swinging movement in one direction (anti-clockwise mounted on the plate 12 at 14 is a U-shaped holding device 15 which is swung by drive means (not shown) between a position in which the holding device firmly presses a sheet bundle B lying on the plate 12 as shown in full lines in FIG. 1, and a position in which the U-shaped holding device is spaced from the sheet bundle, as shown in chain lines in FIG. 1. The sheet bundle B is normally comprised of a bundle of loose paper sheets of mutually the same size (A4).

Each of the covers A is comprised of a sheet of paperboard and/or plastic material that includes told lines along which the sheet is folded and which delimit two cover sheets and a spine located therebetween. Applied to the inner surface of the spine is a binding agent which normally comprises a strip of adhesive thermoplastic material which is solid at room temperature but which softens when heated.

A large number of covers A are packed in containers or cassettes K that are intended for insertion into the machine in a manner illustrated in the Figures and described in more detail hereinafter. Each cassette K is comprised of a box made of paperboard or like material, said box being closed during storage and transportation. Although not shown, the cassette is provided with weakenings which enable part of the cassette be removed so as to expose an opening K1 through which the covers AL can be removed from the cassette. The cassette K includes opposite the opening K1 an abutment means or counterpressure means K2 which functions to centre the covers in the cassette and which may be an integral part thereof. The cassette K also includes a support element K3, preferably in the form of a paperboard wedge, that extends between two cassette side-walls and which can be moved obliquely up and down in the cassette, as evident from FIG. 1.

An empty cassette 9 is filled with covers A by inserting a V-shaped stack of mutually nesting covers into the cassette, for instance through the bottom of the cassette, and thereafter pushing the wedge K3 in through the bottom of the cassette and into the cavity defined by the innermost cover. The cassette bottom is then closed. The outermost cover A of the filled cassette K rests against the abutment surface K2 and a cassette part (not shown) identical to the abutment surface, this cassette part later being removed when opening the cassette, so as to form the opening K1. This cover lies, in turn, against a further cover such that the binding agent on the spine of the first-mentioned cover will be located opposite to and in contact with, or at a short distance from, the outer surface of the spine of the last-mentioned cover. The abutment K2, the cassette part and the wedge K3 ensure that the covers are centred in the cassette and retain their V-configuration.

Shown in the drawings are two parallelepipedic cassettes K with their lids removed, said cassettes being shown in juxtaposed relationship in the illustrated machine. More specifically, each cassette is removably inserted in a carriage 16 and 17 respectively which can be readily moved with the aid of wheels 18 and expanding bars 22, from a position outside the machine frame 1 to a position within said machine.

When one of the carriages 16, 17 carrying a cassette K is pushed into the machine, a sword 19 mounted in the machine penetrates one cassette side-wall and passes into the wedge K3. Subsequent hereto, the sword 19 is moved upwards by a reversible motor 20 connected to the. sword by means of a belt 21. This movement causes the wedge K3 to be moved upwards in the cassette while entraining the covers A as the sword 19 cuts a slot in the cassette side-wall. Cutting of the side-wall can be facilitated by providing said side-wall with suitable perforations, for instance. Alternatively, the cassette may initially be provided with such a slot. The sword, the wedge and the covers continue to move until the uppermost (outermost) cover A acts on a photocell means (not shown) disposed above the cassette K, whereupon the photocell delivers a signal that stops the motor 20.

The activator means 7 includes a transporter that comprises two identical, synchronously driven conveyors 15, each comprising two mutually identical toothed drive belts 51 that are interconnected by means of yokes 52. The shortest distance between the conveyor-interconnecting yokes is less than the height of a cover A. The two belts 51 of each conveyor 50 are driven by identical sprocket wheels 53 that are coupled together by shafts 54. The lower ends of the shafts 54 carry bevel gearwheels 55 which engage with bevel gearwheels 56 mounted on a shaft 57, of which one is rotated by a motor (not shown). Each of the shafts 57 is provided with a respective roller 5. An endless belt 59 runs around the rollers 58 at a speed which is synchronized with the speed of the conveyors 50. A heating Means 60 and a cooling means 61 are disposed between the upper and lower runs of the belt 59.

A cover A, or several covers A, containing a paper bundle B, or respective paper bundles B, inserted between the conveyers 50 by the device 6 are collected by the yoke 52 and the belt 59 as the transporter moves to the right in FIG. 1.

As the covers A with paper bundles B are transported through the actuator device 7, the thermoplastic glue strings on the inner surface of respective spines are heated by the heating device 60, therewith causing the glue to melt, or soften, and the paper sheets to sink thereinto. Subsequent hereto, the covers are moved away from the heating device to the cooling device 61, in which the glue strings solidify and therewith bind the sheet bundles 9 to the inner surface of respective spines. As the casings A and sheet bundles B are passed through the heating path of the device 7, i.e. over the device 60, the paper sheets are jogged by the device 8, so as to straighten out respective sheet edges.

Figure 2:
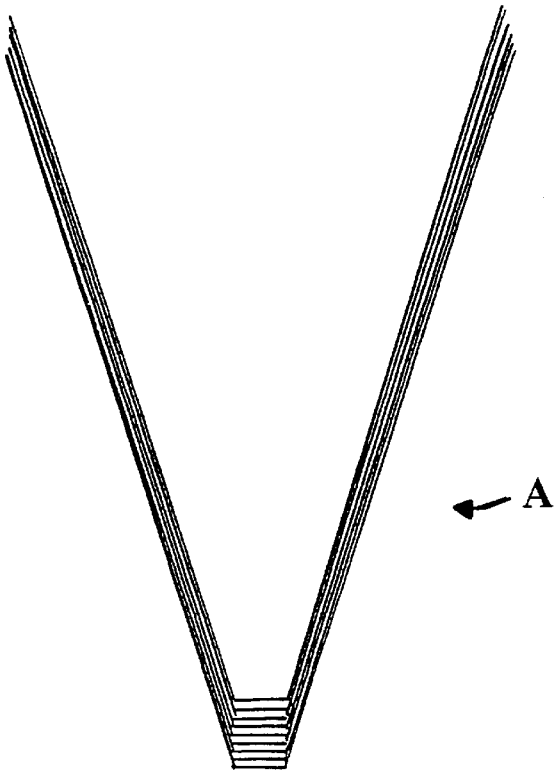
FIG. 2 illustrates a stack of mutually nesting covers.

FIG. 2 illustrates the covers nested in a V-shape stack A. The illustrated covers in the stack A may be covers that are contained in a cardboard box for storage and transportation, or may be the covers stacked in a magazine K1 of a machine according to FIG. 1. Although the covers in the FIG. 1 illustration are shown with their spines facing obliquely upwards, the covers may alternatively be stacked and positioned with their spines facing straight downwards, as shown in FIG. 2. When stacked in this way, the binding device lies on the inner surface of a cover spine and against the outer surface of the immediately adjacent a cover spine. Each binding device is comprised of a glue string applied to the inner surface of the spine of a cover and woven material applied firmly to the surface of the glue string that lies remote from the spine. This enables the covers to be stacked together in the manner shown in FIG. 2 without danger of one cover sticking to the other.

Figure 3:
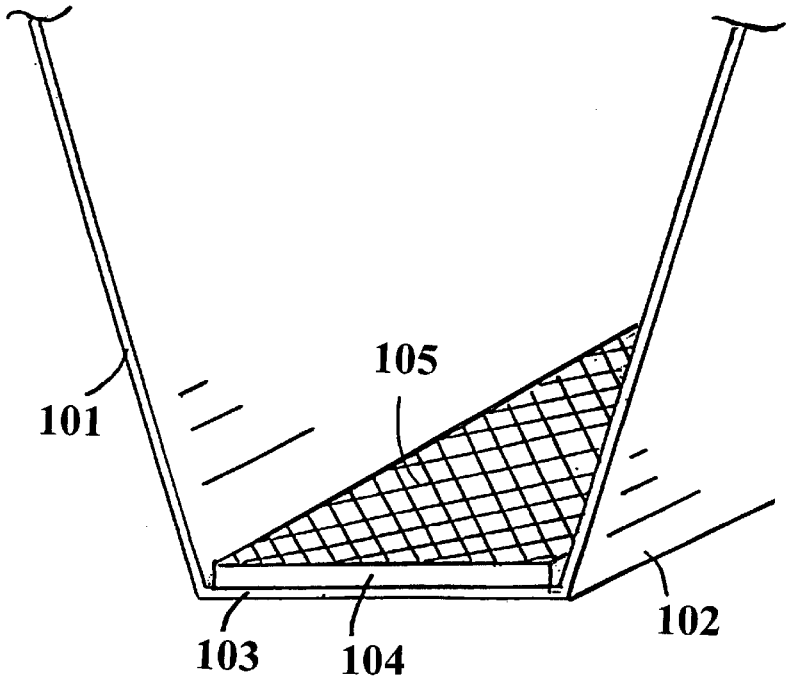
FIG. 3 is a perspective view of part of an inventive cover.
Figure 4:
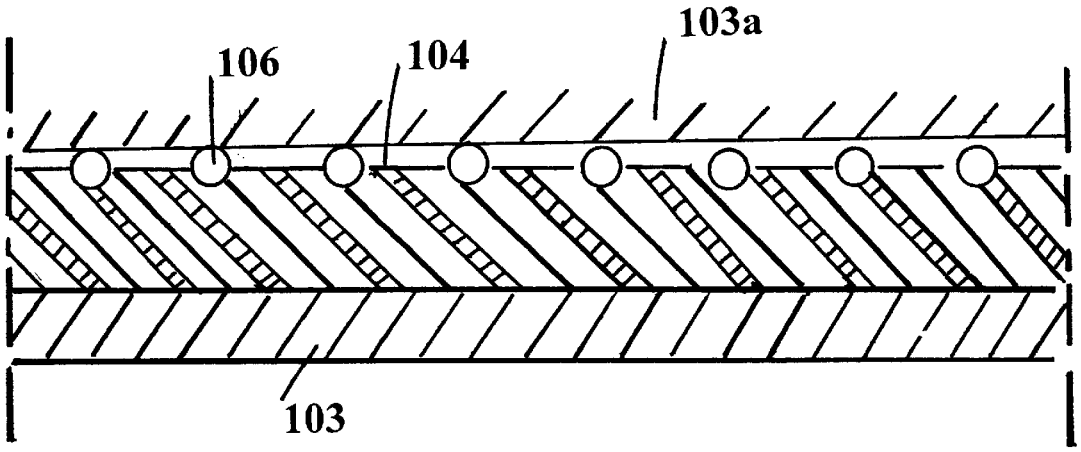
FIG. 4 is a sectional view of part of the spine of an inventive cover.

FIG. 3 is a perspective view of an inventive cover shown in larger scale. The cover comprises the two cover sides 101 and 102 interconnected by a spine 103. The glue string 104 is applied to the inner surface of the spine, essentially along the full length of said spine. The glue used may be any appropriate type of glue typically used in the graphic industry, e.g. an EVA-based melt glue (Ethylene Vinyl Acetate). Attached to its upper surface is a piece of adhesive gauze 106 comprised of 100% cotton and of a kind used commonly in the graphic industry, The gauze 105 forms the separating device that prevents an adjacent cover spine coming into contact with the glue string 104 as illustrated in FIG. 4, which is a sectional view of part of a cover spine in a still larger scale. The cotton threads 106 of the gauze material are partially embedded in the glue string 104 and therewith affixed firmly thereto. FIG. 4 shows only gauze so threads extending in one direction, with those threads that extend angularly to the shown threads being hidden from view. The upper parts of the threads lie above the surface of the glue string, such that the outer surface of an adjacent spine 103*a* nesting in the first-mentioned cover will lie against the upper surface of the gauze threads 106 and therewith leave a gap of some hundreds of a millimeter, which is sufficient to prevent adhesion. The figure is intended to illustrate the principle function of the gauze 105 schematically. In practice, not each individual thread will be partially embedded and partially protruding. Instead, some threads will be partially embedded, some will be completely embedded and some will lie fully on top of the glue surface, although the result will be the same.

Figure 5:
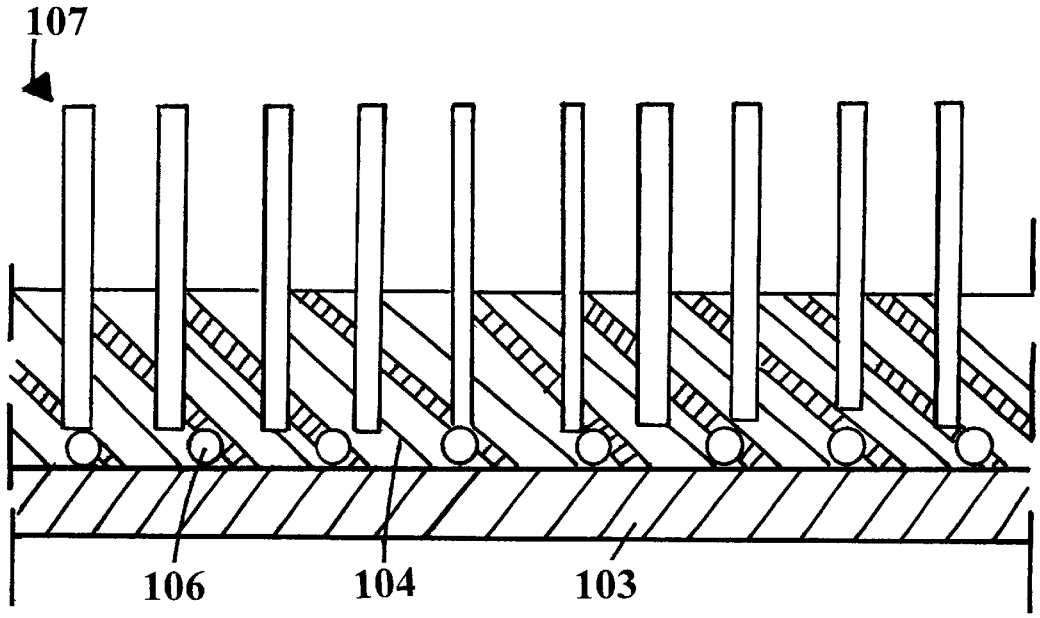
FIG. 5 is a sectional view corresponding to the view of FIG. 4. and illustrating a cover with sheets bound therein.

When such covers are to be used in the production of booklets, a cover is removed from the stack, either manually or mechanically in a machine of the aforedescribed kind, and a bundle of paper sheets is inserted between the cover sheets and brought into abutment with the gauze or like woven material 105. Subsequent hereto, the glue string 104 is heated so as to become molten or semi-molten. The gauze 105 will now no longer be supported to the some extent by the glue string but will sink thereinto as illustrated in FIG. 5. The gauze is therewith pressed into the glue string, either as a result of the weight of the bundle 107 or by actively applying pressure to said bundle The glue string has a thickness of 0.8 am and the gauze threads have a meter of 0.2 mm, so that when the sheet bundle presses the gauze towards the bottom of the glue string, said bundle will be located at a distance of 0.2 mm from the actual spine of the cover. The separating device formed by the gauze is thus deactivated in this stage of the process by the aforedescribed operation, i.e. heating of the glue string and pressing of the sheet bundle against said glue string.

Subsequent to the sheet bundle having reached the position shown in FIG. 5, the glue string is cooled so as to secure the sheet bundle securely in the cover, therewith providing a finished booklet.

It will be understood that the separating device need not necessarily consist of woven material or gauze as in the illustrated embodiment, but may consist of mutually spaced elements applied to the upper surface of the glue string, such as powder for instance. Alternatively, the separating device may consist of a perforated strip, e.g. a perforated plastic strip. The separating function is deactivated in both of these cases, by pressing the separating device down into the molten glue string. Alternatively, the separating device may consist of a fully-covering film of material that completely lacks an adhesive effect and which has approximately the same melting point as the binding agent. In this case, the separating device is deactivated by the device melting and mixing with the molten binding agent.

What is claimed is:

1. A method of stacking together covers for use in the production of booklets, wherein each cover comprises two cover sheets and a spine which interconnects the cover sheets, comprising the steps of providing an activatable binding agent on the inner surface of the spine for affixing a bundle of sheets between the cover sheets, whereby the binding agent remains attached to the inner surface of the spine after affixing the bundle of sheets, stacking the covers in mutual abutment with one another, and providing a deactivatable separating layer made from a woven material between the binding agent and the immediately adjacent cover.

2. A method according to claim 1, further comprising stacking the covers with their respective spines in mutual abutment and with each cover sheet folded outwardly from its respective spine.

3. A method according to claim 1, further comprising affixing the separating layer to the binding agent.

4. A method according to claim 3, further comprising applying the separating layer to a surface of the binding agent that is remote from the spine.

5. A method according to claim 1, further comprising activating the binding agent by heating, and deactivating the separating layer by heating.

6. A cover for use in the production of a booklet, comprising two cover sheets, a spine which interconnects the cover sheets, a binder on the inner surface of the spine, an activatable binding agent in the binder and attached to the spine for affixing a bundle of sheets between the cover sheets, whereby the binding agent remains attached to the spine after affixing the bundle of sheets, and a deactivatable separating layer applied to a surface of the binding agent which is remote from the spine, whereby when, a surface of an adjacent cover is placed against the binder, the deactivatable separating layer serves to prevent direct contact between the binding agent and the surface of the adjacent cover.

7. A cover according to claim 6, wherein the separating layer is adapted to be deactivated at the same time as the binding agent is activated.

8. A cover according to claim 6, wherein the separating layer extends above the surface of the binding agent.

9. A cover according to claim 6, wherein the separating layer is affixed to the binding agent.

10. A cover according to claim 9, wherein the separating layer extends into the binding agent and is thereby affixed to the binding agent.

11. A cover according to claim 6, wherein the separating layer comprises a net structure.

12. A cover according to claim 6, wherein the separating layer comprises a woven material.

13. A cover according to claim 6, wherein the binding agent is adapted to be activated by heating the binding agent.

14. A method of producing a booklet, comprising the steps of providing a cover that includes two cover sheets and a spine that interconnects the cover sheets, applying a binder to a surface of the spine, the binder including an activatable binding agent attached to the spine for affixing a bundle of sheets between the cover sheets, applying a separating device to the binding agent on the surface thereof remote from the spine, placing the bundle of sheets against the separating device, activating and then deactivating the binding agent to secure the bundle of sheets to the spine, whereby the binding agent remains attached to the spine after affixing the bundle of sheets, and deactivating the separating device by activating the binding agent and by pressing the bundle of sheets against the separating device, so as to press the separating device into the binding agent a distance sufficient for the bundle of sheets to penetrate the binding agent and adhere to the spine.

15. A method according to claim 14, wherein the separating device is made of a woven material affixed to the binding agent.

16. A method according to claim 14, wherein the binding agent is activated by heating and deactivated by, cooling.

* * * * *